United States Patent [19]

Chiou

[11] Patent Number: 4,965,033

[45] Date of Patent: Oct. 23, 1990

[54] PROCESS FOR SPINNING HIGH-STRENGTH, HIGH-MODULUS AROMATIC POLYAMIDES

[75] Inventor: Minshon J. Chiou, Richmond, Va.

[73] Assignee: E. I. du Pont de Nemours and Company, Wilmington, Del.

[21] Appl. No.: 498,936

[22] Filed: Mar. 26, 1990

[51] Int. Cl.[5] ..... D01D 5/14; D01F 6/60

[52] U.S. Cl. ..... 264/180; 264/181; 264/184; 264/211.16

[58] Field of Search ..... 264/184, 178 F, 180, 264/181, 210.8, 211.16, 211.15

[56] References Cited

U.S. PATENT DOCUMENTS

| | | | |
|---|---|---|---|
| 3,767,756 | 6/1972 | Blades | 264/184 |
| 4,070,431 | 1/1978 | Lewis et al. | 264/181 |
| 4,078,034 | 12/1978 | Lewis | 264/181 |
| 4,298,565 | 2/1980 | Yang | 264/181 |
| 4,340,559 | 10/1980 | Yang | 264/181 |
| 4,466,935 | 8/1984 | Bair et al. | 264/184 |
| 4,836,507 | 6/1989 | Yang | 264/181 |

FOREIGN PATENT DOCUMENTS 61-102413 5/1986 Japan .

*Primary Examiner*—Hubert C. Lorin

[57] ABSTRACT

A process for spinning high-strength high-modulus, aromatic polyamide filaments is disclosed in which an acid solution containing at least 30 g per 100 ml acid of aromatic polyamide having an inherent viscosity of at least 4 and chain-extending bonds which are either co-axial or parallel and oppositely directed is extruded through a layer of inert noncoagulating fluid into a coagulating bath and then through a spin tube along with overflowing coagulating liquid. Additional coagulating liquid is jetted symmetrically about the filaments in a downward direction forming an angle of 0° C. to 85° with respect to the filaments within about 2.0 milliseconds from the time the filaments enter the spin tube. The flow rates of the jetted and the overflowing coagulating liquids are maintained constant. In the process, the mass-flow ratio, i.e., the ratio of the mass-flow rate of combined coagulating liquid to mass-flow rate of the filaments, is greater than about 250, preferably greater than about 300, and the momentum ratio of jetted to overflowing coagulating liquids of greater than about 6.0 is employed. Also, the average linear velocity of combined coagulating liquids in the spin tube is less than the velocity of the filaments exiting from the spin tube.

5 Claims, No Drawings

PROCESS FOR SPINNING HIGH-STRENGTH, HIGH-MODULUS AROMATIC POLYAMIDES

BACKGROUND OF THE INVENTION

This invention relates to a process for spinning high strength, high modulus aromatic polyamide filaments, particularly at high, commercially desirable spinning speeds.

A process for preparing high strength, high modulus, aromatic polyamide filaments is known from U.S. Pat. No. 3,767,756 whereby highly anisotropic acid solutions of aromatic polyamides whose chain extending bonds are either coaxial or parallel and oppositely directed (para-aramids) are extruded through a spinneret into a layer of inert, non-coagulating fluid into a coagulating bath and then along with overflowing coagulant through a vertical spin tube aligned with the spinneret. Improved results are obtained if the entrance of the spin tube is provided with a deflecting ring as described in U.S. Pat. No. 4,078,034.

The process of U.S. Pat. No. 3,767,756 provides high strength, high modulus filaments of aromatic polyamides such as poly(p-phenylene terephthalamide) which are useful in the construction of vehicle tires, industrial belts, ropes, cables, ballistic vests, protective clothing and other uses.

For high spinning speeds, particularly when the denier of the yarn spun is of the order of 1500 denier or more, U.S. Pat. Nos. 4,298,565 and 4,340,559 provide an improvement over the spinning processes of U.S. Pat. Nos. 3,767,756 and 4,078,034. In accordance with the process of U.S. Pat. No. 4,298,565, the tenacity of the resulting filaments and yarn is increased, usually by a desirably significant amount of at least 1 gram/denier (gpd) (0.88 dN/tex) at a given spinning speed greater than 250 m/min. U.S. Pat. No. 4,298,565 discloses a spinning process in which additional coagulating liquid is jetted downwardly symmetrically about the filaments and travels down the spin tube with the overflowing coagulating liquid. The flow rates of the jetted and overflowing coagulating liquid are maintained constant and the momentum ratio of the jetted to the overflowing liquids being between 0.5 to 6.0. In addition, U.S. Pat. No. 4,298,565 teaches a mass flow rate of total coagulating liquid from 70 to 200 times the mass flow rate of the filaments. U.S. Pat. No. 4,340,559 discloses a spinning process also providing improvements in the high-speed spinning of para-aramid yarns. U.S. Pat. No. 4,340,559 teaches the use of a shallow bath providing substantially horizontal, nonturbulent flow of coagulating liquid toward an orifice for removal of coagulating liquid and fibers. The bath has no more than a minor portion of the coagulating liquid lower than the entrance of the bath orifice.

SUMMARY OF THE INVENTION

It has been discovered that even greater improvements in yarn tenacity are realized in accordance with the process of the present invention in which an acid solution containing at least 30 g per 100 ml acid of aromatic polyamide having an inherent viscosity of at least 4 and chain-extending bonds which are either coaxial or parallel and oppositely directed is extruded through a layer of inert noncoagulating fluid into a coagulating bath and then through a spin tube along with overflowing coagulating liquid. Additional coagulating liquid is jetted symmetrically about the filaments in a downward direction forming an angle of 0° C. to 85° with respect with respect to the filaments within about 2.0 milliseconds from the time the filaments enter the spin tube. The flow rates of the jetted and the overflowing coagulating liquids are maintained constant. In accordance with the invention, the mass-flow ratio, i.e., the ratio of the mass-flow rate of combined coagulating liquid to mass-flow rate of the filaments, is greater than about 250 and the momentum ratio of jetted to overflowing coagulating liquids of greater than about 6.0 is employed. Preferably, the mass-flow ratio is greater than about 300. Also, the average linear velocity of combined coagulating liquids in the spin tube is less than the velocity of the filaments exiting from the spin tube.

In accordance with a preferred form of the process of the present invention, a shallow bath is employed which has a width sufficient to provide substantially nonturbulent flow of coagulating liquid toward the spin tube and which has no more than a minor portion of total coagulating liquid in the bath lower than the entrance to the spin tube.

The process is preferably run at wind-up speeds of at least about 500 yd/min, most preferably at least about 650 yd/min.

BRIEF DESCRIPTION OF THE DRAWINGS

The present invention may best be understood by reference to the following detailed description when considered in conjunction with the accompanying drawing in which.

DETAILED DESCRIPTION

Figure 1:
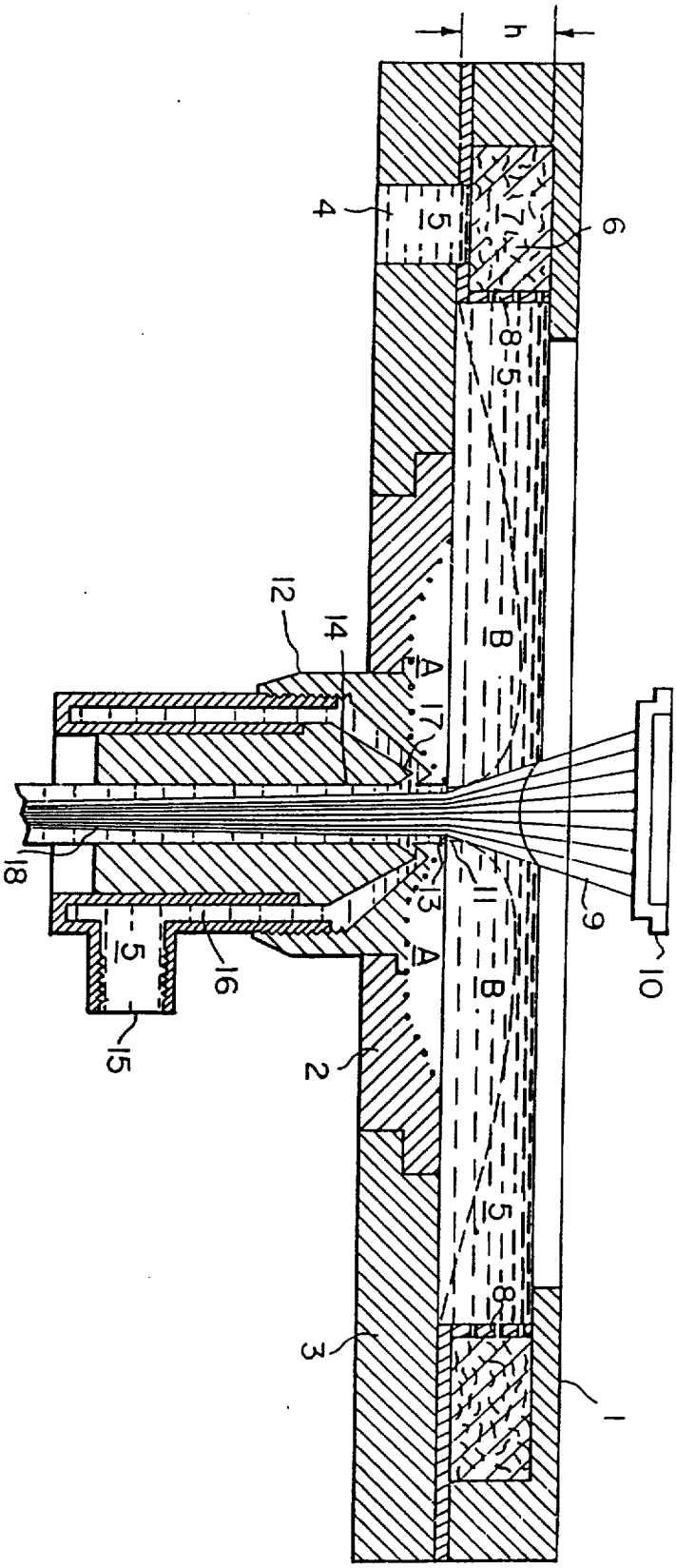
FIG. 1 is a cross-sectional view of a preferred apparatus for use in the process in accordance with the present invention.

In the practice of the invention, aromatic polyamides whose chain extending bonds are either coaxial or parallel and oppositely directed are spun from anisotropic sulfuric acid solutions generally in accordance with U.S. Pat. No. 3,767,756, which is hereby incorporated by reference. It is generally necessary for the inherent viscosity of the polymer to be at least about 4.0 and to be dissolved in sulfuric acid having a concentration of at least about 98%.

In the preferred form of the invention, a coagulating bath is employed as disclosed in U.S. Pat. No. 4,340,559, which is hereby incorporated by reference. The bath of U.S. Pat. No. 4,340,559 has sufficient width to provide substantially horizontal, nonturbulent flow toward a spin tube through which the filaments and coagulating liquid pass.

Typical operation of a process in accordance with the present invention is described with reference to FIG. 1 which is a cross-sectional view of a preferred coagulating bath 1. The bath 1 is a circular structure consisting of an insert disc 2 fitted into supporting structure 3. Supporting structure 3 includes an inlet 4 for introduction of quench liquid 5 under pressure into distribution ring 6 which contains a filler 7 suitable to enhance uniform delivery of quench liquid around the periphery of the coagulating bath 1.

Introduction of coagulating liquid to the bath may be from a peripheral manifold containing baffles or packing to provide uniform distribution and nonturbulent flow of coagulating liquid toward the orifice. In the case of a circular bath, the manifold can surround the bath. In the case of a rectangular bath with a slot orifice, the manifold can still surround the bath but coagulating liquid would be provided only on the sides of the bath which are parallel to the slot. It is necessary only that the flow of coagulating liquid toward the orifice be nonturbulent in the proximity of the orifice. Thus, the filler 7 may be glass beads, a series of screens, a honeycomb structure, sintered metal plates, or other similar device.

After passing through the filler 7, the quench liquid passes through perforated plate or screen 8 and flows uniformly without appreciable turbulence or back mixing horizontally toward the center of bath 1 where the quench liquid 5 contacts filaments 9 extruded from spinneret 10 whereby both quench liquid 5 and filaments 9 pass together through orifice 11 in a downward direction into a spin tube 14.

The bottom of the bath may be contoured as illustrated by the areas indicated by A and B to facilitate the uniform nonturbulent flow toward the opening 11. An area about the orifice may also taper towards the orifice. Preferably, the depth of the coagulating bath is no more than 20% of the bath width in the area of nonturbulent flow.

For spinning on a small scale, e.g., 20 filaments, a suitable bath width is about 2.5 inches (6.35 cm) in combination with an orifice having a diameter of 3.1 mm which has a tapered approach having a beginning diameter of about 12 mm. For larger scale spinning, e.g., 1,000 filaments, a suitable bath width is about 23 cm in combination with an orifice diameter of 9 mm which may have a tapered approach having a beginning diameter of about 28 mm.

Insert disc 2 includes circular jet device 12 which operates similarly to the jet device disclosed in U.S. Pat. No. 4,298,565. The orifice 11 preferably has a lip 13, i.e., the orifice 11 is of slightly smaller diameter than the spin tube 14, to help keep filaments 9 from adhering to the walls of orifice 11 and spin tube 14. Quench liquid 5 is introduced through opening 15 through passageway 16 to one or more jet openings 17 whereby the quench liquid 5 passes along with filaments 9 and other quench liquid 5 in a downward direction through the spin tube to exit 18 toward a forwarding device (not shown). In accordance with known procedures, the filaments are washed and/or neutralized and dried before wind-up of yarns produced by the process.

It is preferable for the angle for the liquid directed by the jet openings 17 in relation to the filaments to form an angle ($\theta$) in the range 0 to 85 degrees. While satisfactory results are also obtainable for $\theta=90$ degrees, this selection of $\theta$, however, makes the process very critical to control and is, therefore, not as desirable in commercial operation. 30 degrees is a particularly suitable angle for use in a commercial production process. The jet openings 17 are located adjacent the orifice 11 and direct the jetted coagulating fluid downwardly toward the filaments within about 2 milliseconds from the time the filaments enter the spin tube.

The process provides the most improvement when the spinneret, spin orifice, jet and any extension of the spin tube are carefully aligned on the same axis and when the jet elements are carefully designed and aligned to provide perfectly symmetrical jetting about the threadlines. Any misalignment of jet elements or the lodging of any solid particles in jet openings so as to destroy symmetry can reduce or eliminate the improvements. Such symmetry may be provided from two or more jet orifices, or from slots symmetrically spaced with respect to the thread line.

In accordance with the process, the flows of the overflowing coagulating liquid ($Q_1$) and jetted coagulating liquid ($Q_2$) are controlled and are maintained constant to achieve the improvement in accordance with the present invention. The mass-flow ratio (R) of the mass-flow rate of combined coagulated liquid to mass-flow rate of the filaments is controlled to be greater than about 250. Preferably, the mass-flow ratio (R) is greater than about 300. In addition, a momentum ratio ($\phi$) of jetted to overflowing coagulating liquids of greater than about 6.0 is employed.

In the practice of the invention, flow-rate of overflowing coagulating fluid ($Q_1$) is controlled by adjustment of the depth of bath above the orifice 11 (dimension h) by metering the inflow into the bath but also depends on the diameter of spin tube 14. Dimension h is ordinarily less than one inch (2.5 cm) and preferably about 0.5 inch (1.3 cm). If h is too small, air will be drawn into spin tube 14 by the pumping action of the advancing filaments, and such is deleterious to both tensile properties and mechanical quality of the yarn produced. Thus, h must be great enough to assure no entrainment of gas bubbles. The above considerations lead to calculation of a suitable diameter of spin tube 14. Because the overflow rate of quench liquid ($Q_1$) through the orifice is greatly influenced by the moving threadline through the same orifice, this effect must also be taken into account. For example, the overflow rate through a 0.375 in. (9.5 mm) diameter orifice under a hydrostatic head of 0.625 in. (15.9 mm) is approximately 0.4 gallons per minute in the absence of a moving threadline, and 2.3 gallons per minute in the presence of a threadline of 1000 filaments of 1.5 denier per filament moving at 686 m/min. This is commonly attributed to the pumping effect of moving filaments through a layer of liquid due to boundary layer phenomena. To compensate for this effect, the orifice size, i.e., diameter of cross-sectional area is suitably selected.

The flow-rate of jetted coagulating liquid ($Q_2$) is preferably controlled by metered pumping through a jet opening of selected size. The minor cross-sectional dimension of the jet (e.g., hole diameter or slot width) is generally in the range of 2 to 100 mils (0.05 to 2.5 mm). It is desirable for the flow-rate and the jet opening to be such that the axial velocity of the of the jetted coagulating liquid exceeds at least about 50% of that of the yarn being processed and preferably should exceed at least about 80% of the yarn velocity to prevent dragging of the threadline which results in a decrease in tenacity. However, the axial velocity of jetted coagulating liquid should not greatly exceed 200% of that of the yarn being processed and preferably does not exceed about 150% of the yarn velocity to prevent buffeting the threadline which can result in a reduction in measured yarn tenacity. It is therefore necessary to employ a suitable jetted liquid flow-rate and jet openings or slots which provide the mass-flow ratio of combined coagulating liquid to filament mass of greater than about 250, preferably greater than about 300, and the momentum ratio of jetted to overflowing coagulating liquids of greater than about 6.0 which also provide a suitable velocity for the jetted coagulating liquid in relation to yarn speed.

In the process of the invention, the average linear velocity of the combined coagulating liquids in the spin tube is maintained at a velocity less than the velocity of the filaments exiting from the spin tube. This prevents a loss of yarn tenacity due to "looping" of filaments in the yarn and possible process continuity problems due to the absence of sufficient tension before the feed rolls.

The present invention is useful for a wide range of spinning speeds and is particularly useful for spinning speeds of at least about 500 yd/min and preferably at least about 650 yd/min although higher spinning speeds do result in a reduction in tenacity when compared to lower spinning speeds. When compared to known processes, tenacity is increased by the process of the present invention at all spinning speeds and surprisingly the improved tenacity is achieved at high spinning speeds such as 850 yd/min and higher enabling the commercial use of such spinning speeds. While the advantages in tenacity produced by the process of the invention continue to increase with both increasing mass-flow ratio (R) and momentum ratio ($\phi$) and thus can compensate for tenacity decreases due to continued increases in spinning speed, it is believed that mass-flow ratios (R) of above 5000 and momentum ratios ($\phi$) above 50 will not yield any further significant improvement and will not be economically attractive for technical production, especially heavy deniers such as 1500 denier.

TEST PROCEDURES

Inherent Viscosity

Inherent viscosity ($\eta_i$) is computed by dividing the natural logarithm of ($t_2/t_1$) by C where C=0.5 gm of polymer per deciliter of 95–98% sulfuric acid, $t_2$ is flow-time at 30° C. of the polymer solution through a capillary viscometer, and $t_1$ is the corresponding flow-time of solvent alone.

Linear Density

Linear density is the weight in grams of a specified length of yarn (filaments). When expressed as denier, the length is 9000 m. When expressed as dtex, the length is 10,000 m. A dry, equilibrated length of about one meter is measured, weighed, and then converted to the customary linear density.

Tensile Properties

Yarn properties are measured at 24° C. and 55% RH on yarns which have been conditioned under the test conditions for a minimum of 14 hours. Before testing, each untwisted yarn (bundle of as-spun filaments) is twisted to a 1.1 twist multiplier (TM) where $TM=(denier)^{\frac{1}{2}}(tpi)/73 \quad =(dtex)^{\frac{1}{2}}(tpc)/30.3$, tpi is turns per inch, and tpc is turns per cm. Tenacity, modulus, and elongation are determined from the output of a recording laboratory stress/strain analyzer using 25.4 cm gage lengths of yarn elongated at 50% strain per minute (based on starting length).

Momentum Ratio($\phi$)

The momentum ratio is defined as the ratio of momentum ($M_2$) along the threadline direction for jetted coagulating liquid to momentum ($M_1$) of the overflowing coagulating liquid; i.e., $\phi=M_2/M_1$. Momentum is defined as the product of the mass-rate and the velocity of flow. Calculation of momentum ratio is described in the aforementioned U.S. Pat. No. 4,298,565, and in the examples is computed from $$\phi = \frac{Q_2^2 \cdot d_1^2 \cos\theta}{4Q_1^2 \cdot d_2 (d_1 + d_2 \cos\theta)}$$

wherein $Q_1$ is the flow rate of overflowing liquid $Q_2$ is the flow rate of jetted liquid $d_1$ is the inner diameter of the spin tube $d_2$ is the minor dimension of the jet opening $\theta$ is the acute angle between the jetted liquid and the threadline.

As long as $d_1$ and $d_2$ and $Q_1$ and $Q_2$ are in the same units, the ratio $\phi$ is independent of the units selected.

Mass-Flow Ratio (R)

This is the ratio of the mass-flow rate of total coagulating liquid to the mass-flow rate of filaments (dry basis). The basic unit of liquid flow rate Q herein is gal/min.

$$Q \times 3899 = \text{mass-flow in g/min}$$

For the yarn, basic units are speed (Y) in yd/min and denier (D) in g/9000m.

$$YD \times (0.9144/9000) = \text{mass-flow in g/min.}$$

The mass-flow ratio then becomes $Q/YD \times 3.8376 \times 10^7$.

In this equation it is assumed that density of the coagulating liquid is about 1.03 g/mL.

EXAMPLES

In the following examples, poly(paraphenylene terephthalamide) (PPD-T) having an inherent viscosity of 6.3 dL/g before solutioning and about 5.4 dL/g in fiber form was spun into apparatus as illustrated in FIG. 1. The diameter of the spin tube was 0.3 inch (0.76 cm) and jets of 8 and 16 mils were employed with an angle of 30 degrees between the jetted stream and the threadline. The solvent employed in making spin dope was 100.1% sulfuric acid with the concentration of polymer in each spin dope was 19.4+0.1 weight % of the dope.

As indicated in Table I, the spinnerets employed had 133, 266, 500, 667 and 1000 capillaries each having a diameter of 2.5 mils (0.065 mm). The air-gap employed, i.e., the distance of filament travel from the exit face of the spinneret to the first contact with coagulating liquid, was 0.25 in (0.635 cm).

EXAMPLE I

This example is of three parts, all using a yarn speed of 650 yd/min (594 m/min). Additional processing conditions are in Table I, and product characteristics in Table II. The average linear velocity, $V_q$, of the combined coagulating liquids in the spin tube is also shown in Table I.

The first part illustrates the invention (Example I-A) with very high mass-flow ratio (R) and momentum ratio ($\phi$). The second part (Example I-B) also illustrates the invention yet with a lower mass-flow ratio (R) and momentum ratio($\phi$). The third part (Example I-Comp.) is a comparison example utilizing a mass-flow ratio (R) and a momentum ratio ($\phi$) low enough to be within the prior art.

It is apparent that significantly improved yarn tenacities can be obtained using the process of the present invention.

EXAMPLE II

This example is also of three parts all using a yarn speed of 850 yd/min (777 m/min). Additional processing conditions are in Table I, and product characteristics in Table II. The average linear velocity, $V_q$, of the combined coagulating liquids in the spin tube is also shown in Table I.

The three parts are as described in Example I with examples II-A and II-B illustrating the invention but of quite different mass-flow ratios (R) and momentum ratios ($\phi$) and Example II-Comp. being at a mass-flow ratio (R) and momentum ratio ($\phi$) low enough to be within the prior art.

It can be seen that significantly improved yarn tenacity can be obtained using the process of the present invention.

EXAMPLE III

This example is also of three parts all using a yarn speed of 500 ypm (457 m/min). Additional processing conditions are in Table I, and product characterizations in Table II. The average linear velocity, Vq, of the combined coagulating liquids in the spin tube is also shown in Table I.

The three parts are as described in Example I with examples III-A and III-B illustrating the invention but with different mass-flow ratios (R) and Example III-Comp. being at a mass-flow ratio (R) and momentum ratio ($\phi$) low enough to be within the prior art.

It can be seen that significantly improved yarn tenacity can be obtained using the process of the present invention.

TABLE I

| | Specific Process Conditions | | | | | | | | |
|---|---|---|---|---|---|---|---|---|---|
| | I-A | I-B | I-COMP | II-A | II-B | II-COMP | III-A | III-B | III-COMP |
| No. Filaments | 133 | 266 | 1000 | 133 | 266 | 1000 | 500 | 667 | 667 |
| Spin Dope | | | | | | | | | |
| Flow rate (g/min) | 68.1 | 136.2 | 510.7 | 89.1 | 178.2 | 667.9 | 196.4 | 261.9 | 261.9 |
| Ext. Temp. (°C.) | 74 | 74 | 71 | 74 | 74 | 71 | 71 | 71 | 71 |
| Jet Width | | | | | | | | | |
| (mils) | 16 | 16 | 8 | 16 | 16 | 8 | 16 | 16 | 8 |
| (mm) | .41 | 0.41 | 0.20 | 0.41 | 0.41 | 0.20 | 0.41 | 0.41 | 0.20 |
| $Q_1$ | | | | | | | | | |
| (gal/min) | 1.8 | 1.9 | 2.1 | 1.9 | 2.0 | 2.2 | 1.8 | 1.8 | 1.7 |
| (L/min) | 6.81 | 7.19 | 7.95 | 7.19 | 7.57 | 8.33 | 6.81 | 6.81 | 6.43 |
| $Q_2$ | | | | | | | | | |
| (gal/min) | 2.9 | 3.0 | 1.4 | 3.1 | 3.5 | 1.6 | 2.3 | 2.3 | 0.9 |
| (L/min) | 10.98 | 11.36 | 5.30 | 11.73 | 13.25 | 6.06 | 8.70 | 8.70 | 3.41 |
| $V_q$ | | | | | | | | | |
| (yd/min) | 427 | 445 | 318 | 454 | 499 | 345 | 372 | 372 | 236 |
| (m/min) | 390 | 407 | 291 | 415 | 456 | 315 | 340 | 340 | 216 |
| $\phi$ | 10.07 | 9.67 | 3.53 | 10.33 | 11.88 | 4.20 | 6.32 | 6.32 | 2.22 |
| R | 1387 | 723 | 138 | 1129 | 621 | 114 | 420 | 315 | 199 |

TABLEL II

| | Product Characterization | | | | | | | | |
|---|---|---|---|---|---|---|---|---|---|
| | I-A | I-B | I-COMP | II-A | II-B | II-COMP | III-A | III-B | III-COMP |
| Linear Density | | | | | | | | | |
| (Denier) | 195 | 387 | 1491 | 194 | 387 | 1502 | 736 | 999 | 980 |
| (dtex) | 217 | 430 | 1657 | 215 | 430 | 1669 | 818 | 1110 | 1089 |
| Tenacity | | | | | | | | | |
| (g/den) | 27.3 | 25.9 | 24.1 | 25.2 | 24.7 | 22.6 | 26.3 | 26.1 | 24.8 |
| (dN/tex) | 24.1 | 22.9 | 21.3 | 22.3 | 21.8 | 20.0 | 23.2 | 23.0 | 21.9 |
| Modulus | | | | | | | | | |
| (g/den) | 778 | 642 | 634 | 665 | 606 | 527 | 789 | 735 | 706 |
| (dN/tex) | 688 | 567 | 560 | 588 | 536 | 466 | 698 | 650 | 624 |
| Elongation (%) | 3.31 | 3.67 | 3.60 | 3.47 | 3.84 | 3.85 | 3.11 | 3.36 | 3.30 |

I claim:

1. In a process for preparing high-strength, high-modulus aromatic polyamide filaments by extruding an acid solution containing at least 30 g per 100 ml acid of an aromatic polyamide having an inherent viscosity of at least 4 and chain-extending bonds which are either coaxial or parallel and oppositely directed through a layer of inert noncoagulating fluid into a coagulating bath and then through a spin tube along with overflowing coagulating liquid, by jetting additional coagulating liquid symmetrically about the filaments in a downward direction forming an angle of 0° to 85° with respect to the filaments within about 2.0 milliseconds from the time the filaments enter the spin tube, by maintaining constant the flow rates of both the jetted and the overflowing coagulating liquids, and winding up the filaments, the improvement comprising employing a mass-flow ratio of the mass-flow rate of combined coagulating liquid to mass-flow rate of the filaments of greater than about 250, employing a momentum ratio of jetted to overflowing coagulating liquids of greater than about 6.0, and maintaining an average linear velocity of combined coagulating liquids in the spin tube which is less than the velocity of the filaments exiting from the spin tube.

2. The process of claim 1 wherein said mass-flow ratio is greater than about 300.

3. The process of claim 1 further comprising employing a shallow bath, said bath having sufficient width to provide substantially nonturbulent flow of coagulating liquid toward said spin tube and having no more than a minor portion of total coagulating liquid in said bath lower than the entrance to said spin tube.

4. The process of claim 1 wherein said filaments are wound up at a speed of at least about 500 yd/min.

5. The process of claim 1 wherein said filaments are wound up at a speed of at least about 650 yd/min.

* * * * *

UNITED STATES PATENT AND TRADEMARK OFFICE

CERTIFICATE OF CORRECTION

PATENT NO. : 4,965,033
DATED : October 23, 1990
INVENTOR(S) : Minshon J. Hereto

It is certified that error appears in the above-identified patent and that said Letters Patent is hereby corrected as shown below:

Delete Title page and substitute therefor the attached Title page.

Signed and Sealed this

Twenty-second Day of April, 1997

Bruce Lehman

*Attest:*

BRUCE LEHMAN

*Commissioner of Patents and Trademarks*

*Attesting Officer*

United States Patent [19]

Chiou

[11] Patent Number: 4,965,033

[45] Date of Patent: Oct. 23, 1990

[54] PROCESS FOR SPINNING HIGH-STRENGTH, HIGH-MODULUS AROMATIC POLYAMIDES

[75] Inventor: Minshon J. Chiou, Richmond, Va.

[73] Assignee: E. I. du Pont de Nemours and Company, Wilmington, Del.

[21] Appl. No.: 498,936

[22] Filed: Mar. 26, 1990

[51] Int. Cl.[5] ..... D01D 5/14; D01F 6/60

[52] U.S. Cl. ..... 264/180; 264/181; 264/184; 264/211.16

[58] Field of Search ..... 264/184, 178 F, 180, 264/181, 210.8, 211.16, 211.15

[56] References Cited

U.S. PATENT DOCUMENTS

| | | | |
|---|---|---|---|
| 3,767,756 | 6/1972 | Blades | 264/184 |
| 4,070,431 | 1/1978 | Lewis et al. | 264/181 |
| 4,078,034 | 12/1978 | Lewis | 264/181 |
| 4,298,565 | 2/1980 | Yang | 264/181 |
| 4,340,559 | 10/1980 | Yang | 264/181 |
| 4,466,935 | 8/1984 | Bair et al. | 264/184 |
| 4,836,507 | 6/1989 | Yang | 264/181 |

FOREIGN PATENT DOCUMENTS 61-102413 5/1986 Japan .

*Primary Examiner*—Hubert C. Lorin

[57] ABSTRACT

A process for spinning high-strength high-modulus, aromatic polyamide filaments is disclosed in which an acid solution containing at least 30 g per 100 ml acid of aromatic polyamide having an inherent viscosity of at least 4 and chain-extending bonds which are either co-axial or parallel and oppositely directed is extruded through a layer of inert noncoagulating fluid into a coagulating bath and then through a spin tube along with overflowing coagulating liquid. Additional coagulating liquid is jetted symmetrically about the filaments in a downward direction forming an angle of 0° C. to 85° with respect to the filaments within about 2.0 milliseconds from the time the filaments enter the spin tube. The flow rates of the jetted and the overflowing coagulating liquids are maintained constant. In the process, the mass-flow ratio, i.e., the ratio of the mass-flow rate of combined coagulating liquid to mass-flow rate of the filaments, is greater than about 250, preferably greater than about 300, and the momentum ratio of jetted to overflowing coagulating liquids of greater than about 6.0 is employed. Also, the average linear velocity of combined coagulating liquids in the spin tube is less than the velocity of the filaments exiting from the spin tube.

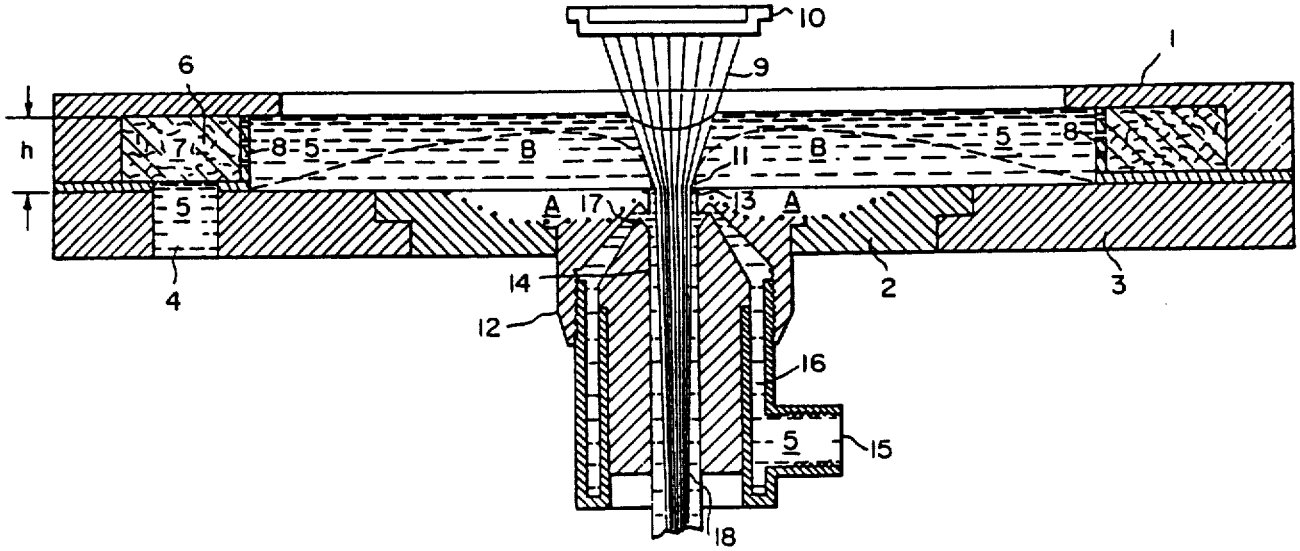

5 Claims, 1 Drawing